US006889996B2

(12) United States Patent
Chonier et al.

(10) Patent No.: US 6,889,996 B2
(45) Date of Patent: May 10, 2005

(54) SAFETY BINDING WITH PURCHASE ON THE UPPER

(75) Inventors: Frédéric Chonier, Nevers (FR); Frédéric Quillard, Nevers (FR); Jean-Louis Chevalier, Varennes Vauzelles (FR); Michel Thevenet, Coulanges les Nevers (FR)

(73) Assignee: Look Fixations S.A., Nevers (FR)

( * ) Notice: Subject to any disclaimer, the term of this patent is extended or adjusted under 35 U.S.C. 154(b) by 241 days.

(21) Appl. No.: 09/015,234

(22) Filed: Jan. 29, 1998

(65) Prior Publication Data

US 2002/0053784 A1 May 9, 2002

(30) Foreign Application Priority Data

Jan. 29, 1997 (FR) ..... 97 01235
Mar. 25, 1997 (FR) ..... 97 03912

(51) Int. Cl.[7] ..... A63C 9/08
(52) U.S. Cl. ..... 280/625; 280/629
(58) Field of Search ..... 280/611, 613, 280/623, 625, 626, 628, 629, 633, 634, 636

(56) References Cited

U.S. PATENT DOCUMENTS 4,410,199 A * 10/1983 Eisenberg ..... 280/615
4,478,426 A * 10/1984 Scheck ..... 280/625
4,593,928 A * 6/1986 Scheck et al. ..... 280/625
4,735,435 A * 4/1988 Hornschemeyer et al. .. 280/625
4,779,892 A * 10/1988 Dimier et al. ..... 280/628
4,902,031 A * 2/1990 Bogner ..... 280/625
4,974,869 A * 12/1990 Muhlberger et al. ..... 280/625
4,989,893 A * 2/1991 Kowatsch et al. ..... 280/625
5,016,902 A * 5/1991 Goud et al. ..... 280/630
5,121,939 A * 6/1992 Peyre ..... 280/634
5,193,841 A * 3/1993 Stritzl et al. ..... 280/625
5,205,575 A * 4/1993 Wladar ..... 280/625
5,257,798 A * 11/1993 Stritzl et al. ..... 280/625
5,273,306 A * 12/1993 Wawra ..... 280/625
5,328,201 A * 7/1994 Wladar ..... 280/625
5,333,891 A * 8/1994 Stritzl et al. ..... 280/625
5,333,892 A * 8/1994 Stritzl et al. ..... 280/625
5,529,331 A * 6/1996 Hoelzl et al. ..... 280/634
5,702,119 A * 12/1997 Challande et al. ..... 280/625
5,890,731 A * 4/1999 Challande et al. ..... 280/625
6,053,523 A * 4/2000 Quillard et al. ..... 280/625
6,092,831 A * 7/2000 Bauvois ..... 280/625

FOREIGN PATENT DOCUMENTS

DE 3403113 A 8/1984
EP 320854 A 6/1989
WO WO 9525567 A 9/1995

* cited by examiner

*Primary Examiner*—Christopher P. Ellis
*Assistant Examiner*—Bridget Avery
(74) *Attorney, Agent, or Firm*—Frommer Lawrence & Haug LLP; Ronald R. Santucci

(57) ABSTRACT

Safety binding for a ski boot, which has a jaw having two arms (3, 4) which are independent so as to open in an opposite manner to one another when the boot is put on and are capable of retaining the boot vertically via its projecting sole (10) the jaw being able to pivot laterally counter to the action of a return spring. The arms (3, 4) bear on the upper (11) of the boot, while the sole (10) bears on front-bearing means (12, 13) which are located either on the arms or on the base (1). This binding adapts automatically to the boot.

6 Claims, 4 Drawing Sheets

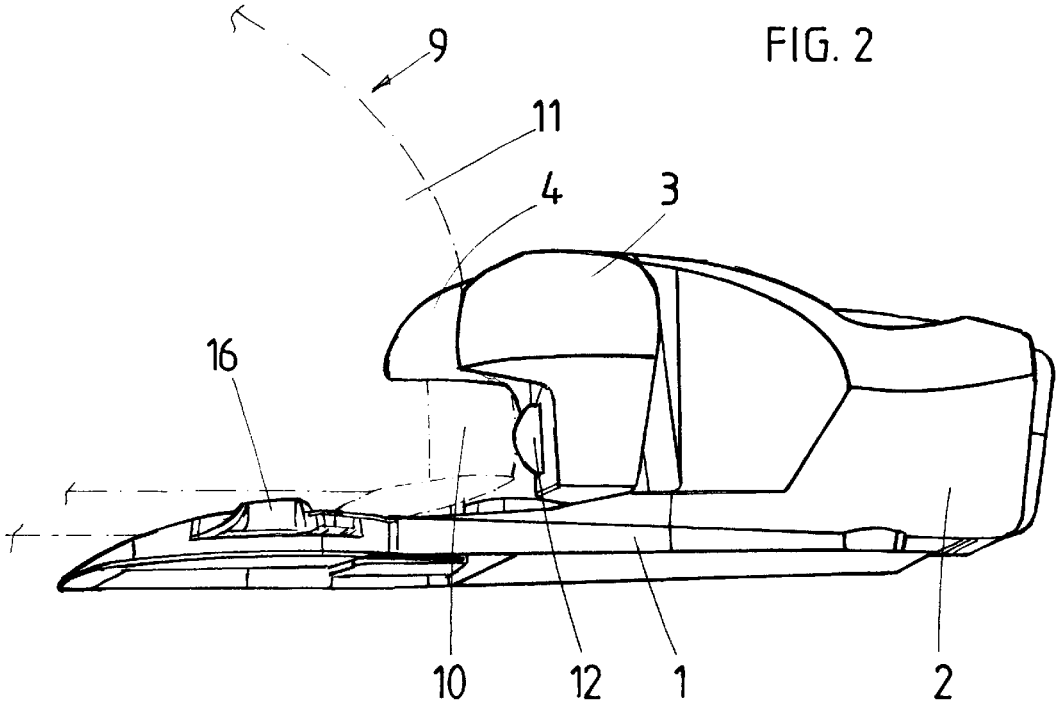
FIG. 2
FIG. 3
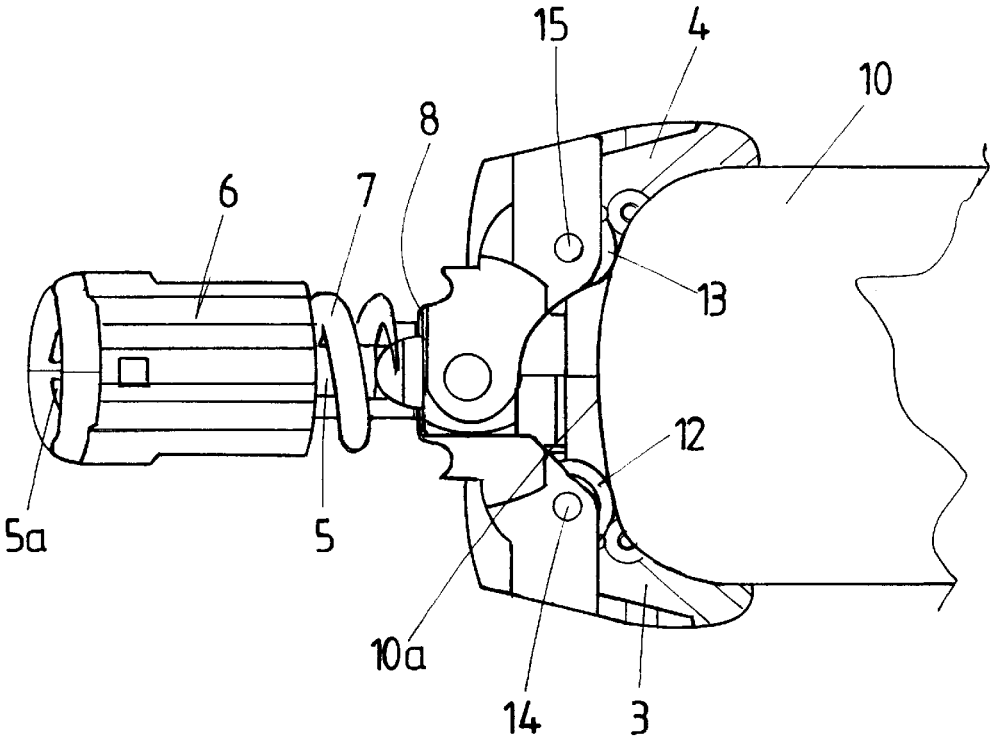

FIG. 4
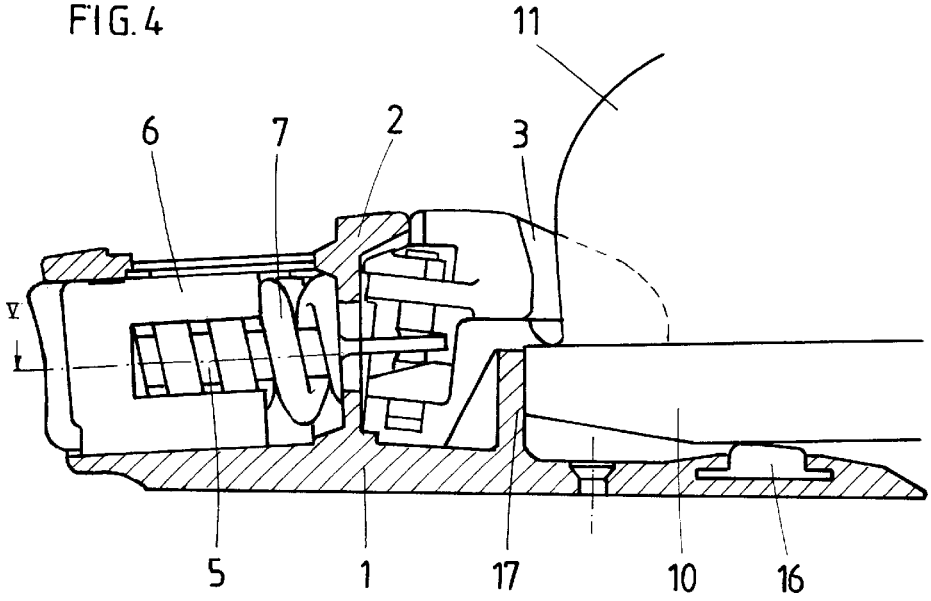
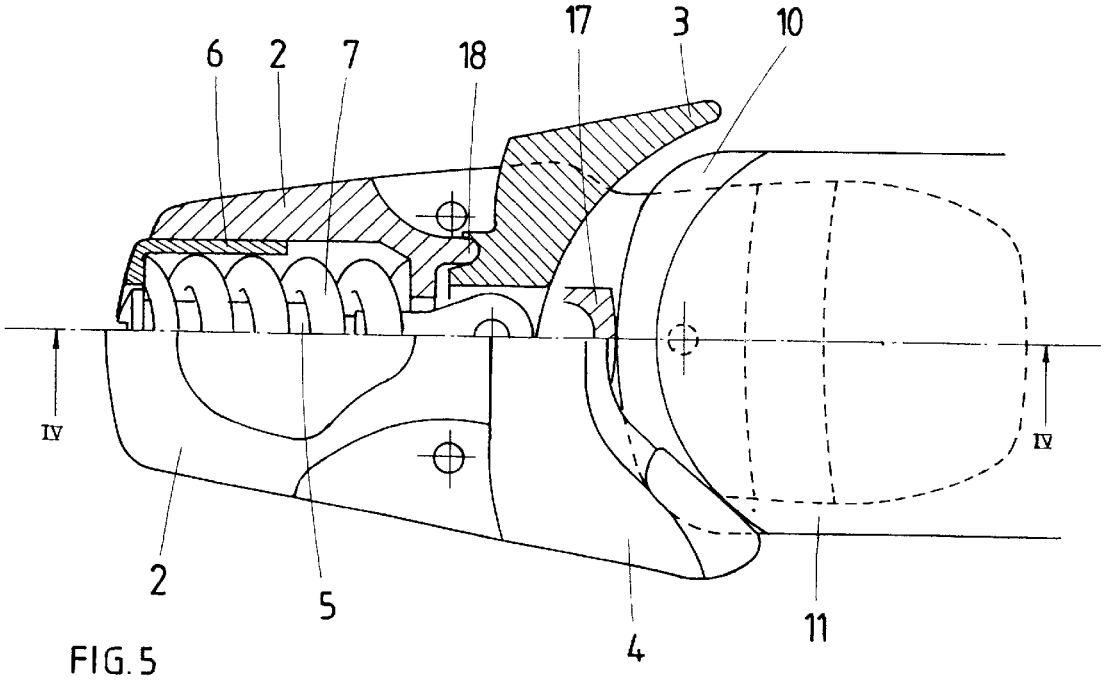
FIG. 5

SAFETY BINDING WITH PURCHASE ON THE UPPER

FIELD OF THE INVENTION

The present invention relates to a safety binding for fixing a ski boot with a projecting sole on a ski, comprising a jaw having two arms which are independent so as to open in an opposite manner to one another when the boot is put on and are capable of retaining the boot vertically via its projecting sole, the jaw being able to pivot laterally under the action of the boot counter to the action of a return spring.

The invention relates in particular to a binding intended for fixing the front end of the boot, but it could equally be applied to the binding of the rear end of the boot.

PRIOR ART

In general terms, there are three types of front binding.

In bindings of the first type, the jaw retains the boot laterally and vertically via the projecting part of the sole by means of two arms which are independent so as to open in an opposite manner to one another when the boot is put on. By way of example, the bindings described in Patent Application DE 2 756 895 and in Patent EP 0 295 372 can be cited. In view of the shape of the front end of the sole, the elastic travel of the boot, that is to say the lateral displacement of the boot before it escapes from the binding, is relatively short, which may result in premature escape of the boot, causing the skier to fall. Another disadvantage of this type of binding lies in the accumulation of snow under the jaws, between the latter and the ski or the plate on which the sole of the boot slides laterally.

Patent EP 0 241 360 illustrates a binding of the second type. In this binding, the boot is retained laterally via its upper and vertically via the top face of the projecting sole, the arms then bearing at points further from the axis of the boot and on a surface which is much more rounded than the end of the sole, so that a large elastic travel is obtained. Moreover, the arms of the jaw are at a considerably greater height above the support plate of the sole and the ski, so that the snow is not retained under the jaw. A disadvantage of such a binding, however, is the great pressure of the jaw on the upper, that is to say the shell of the boot, which does not have the rigidity and strength of the sole and which may therefore be deformed under the pressure of the jaw, modifying entirely the conditions of release of the binding. Another disadvantage lies in the fact that, during a forward fall, the entirety of the forward thrust is exerted on the arms, which may cause a release of the front binding, whereas it is the role of the heel-holder to release.

The third type of binding, described in Patent FR 2 464 727, comprises two arms bearing on the upper of the boot, and a front stop against which the sole bears. The arms are connected rigidly to the pivoting body of the binding and they cannot move away from one another. In order to ensure support at the front and on the upper, the distance to which the arms are moved away can be adjusted by means of stop screws. Such adjustment is delicate. If the arms are too tight, the upper is crushed when the sole comes into abutment. The resulting deformation of the upper and increase in the contact surface area of the arms with the upper may hamper the release of the binding. If the arms are moved too far away, which may be the result of misadjustment, play is created which results in poor guidance of the ski and therefore a feeling of insecurity.

SUMMARY OF THE INVENTION

The aim of the present invention is to produce a ski binding which has all the advantages of known bindings but does not require manual adjustment of the arms of the jaw.

To this end, the ski binding according to the invention is characterized in that the two arms of the jaw have lateral-bearing means intended to bear on the upper on either side of the boot and in that said binding has front-bearing means intended to serve as support for the front part of the sole of the boot.

The independence of the arms of the jaw allows them to be moved away, counter to the action of the return spring of the binding, so that the front end of the sole can come into abutment against the front-bearing means. The greater part of the axial force exerted by the other binding element on the boot is therefore supported by the front-bearing means. Furthermore, the jaw is adjusted automatically to the width of the upper of the boot. This automatic adaptation leads to efficient interaction between binding and boot, making it possible to obtain a high-performance binding.

Moreover, the free space under the arms of the jaw, on each side of the front-bearing means, allows the snow to empty out.

The front-bearing means are preferably constituted by rollers with a vertical axis.

These rollers may be mounted on the jaw, preferably about axes which are separate from the pivoting axes of the arms of the jaw.

Advantageously, those parts of the arms of the jaw which come to bear against the upper have a low coefficient of friction or are equipped with rollers.

BRIEF DESCRIPTION OF THE DRAWINGS

The attached drawing shows by way of example two embodiments of the invention.

FIG. 2 is a perspective view from below, the boot being shown in dot/dash lines, of the same embodiment.

FIG. 3 is a view from below of the binding, without the body of the latter and without the support plate of the sole, the boot being engaged in the stop under the thrust of a rear binding or heel-holder.

FIG. 4 is a view in axial section, along IV—IV in FIG. 5, of a second embodiment.

FIG. 5 is a plan view, partially in section along V—V in FIG. 4, of this second embodiment.

DESCRIPTION OF THE PREFERRED EMBODIMENTS

Figure 1:
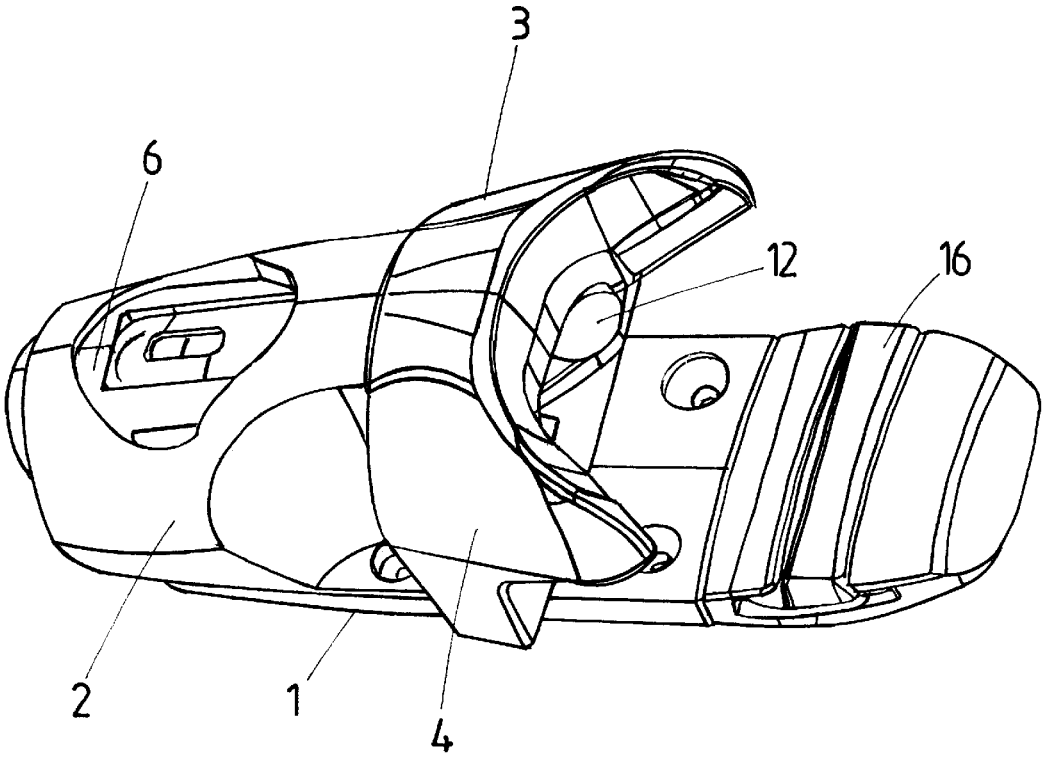
FIG. 1 is a perspective view from above of the binding, in this case a front bearing according to a first embodiment.

The binding shown in FIGS. 1 to 3 comprises a base 1, on which a binding body 2 is mounted, which bears a jaw consisting of two arms 3 and 4 mounted independently rotatably about two vertical axes located on either side of the longitudinal axis of the binding, as described and shown in Patent EP 0 295 372. These arms 3 and 4 constitute levers of the first kind, the inner ends of which act on a rod 5, the end 5*a* of which bears on a bush 6, against the bottom of which a spring 7 bears, which works under compression between the bottom of the bush and a fixed bearing-face 8. This construction is similar to the construction described in Patent EP 0 295 372.

The arms 3 and 4 are located at such a height in relation to the base 1 that, when the boot 9 is engaged in the stop, the arms 3 and 4 are located above the standardized sole 10 of the boot and bear on the upper 11 of the boot. In their bearing zone, the arms 3 and 4 are advantageously equipped with added pieces which have a low coefficient of friction.

The arms 3 and 4 respectively bear a roller 12 and 13 mounted about a vertical spindle 14, respectively 15, which is separate from the pivoting axis of the corresponding arm and located between this pivoting axis and that part of the arm bearing against the upper of the boot. The rollers 12 and 13 constitute front-bearing means for the front part 10*a* of the sole 10 which projects in front of the upper 11.

When the boot is fixed between the front binding element shown and a rear binding element, the sole 10 bears on a bearing surface 16 fixed on the base 1 and its front part 10*a* comes into abutment against the rollers 12 and 13, moving away slightly the arms 3 and 4 which are thus automatically adjusted to the width of the upper 11. In view of the position of the spindles 14 and 15 of the rollers 12 and 13, the axial thrust on these rollers has only little effect on the rod 5. In any case, the rollers 12 and 13 support most of the axial force exerted on the boot. The bearing zone of the arms 3 and 4 on the upper 11 of the boot may vary slightly according to the axial force and the dimensions and the shape of the upper, but this has virtually no influence on the return force of the arms.

When adequate torsion is exerted on the boot 9, the latter moves away one of the arms 3 or 4. In view of the relatively great length of these arms and the corresponding envelopment of the upper by the arms, the elastic travel of the arms is relatively great before the boot escapes from the binding.

Moreover, it emerges clearly from FIGS. 1 and 2 that the snow cannot accumulate in the jaw, under the arms 3 and 4, given that the space is free under these arms, allowing the snow to empty out.

Each of the arms 3 and 4 could be provided with one or more rollers, via which the arms would bear on the upper of the boot.

The second embodiment, shown in FIGS. 4 and 5, differs from the first embodiment in that the front-bearing means are constituted by a stop 17 which is integral with the base 1. In this particular case, this stop 17 is formed in one piece with the base. In FIG. 5, the vertical rib 18 can be seen, on which the arm 3 pivots.

The stop 17 could also be equipped with rollers.

Figure 7:
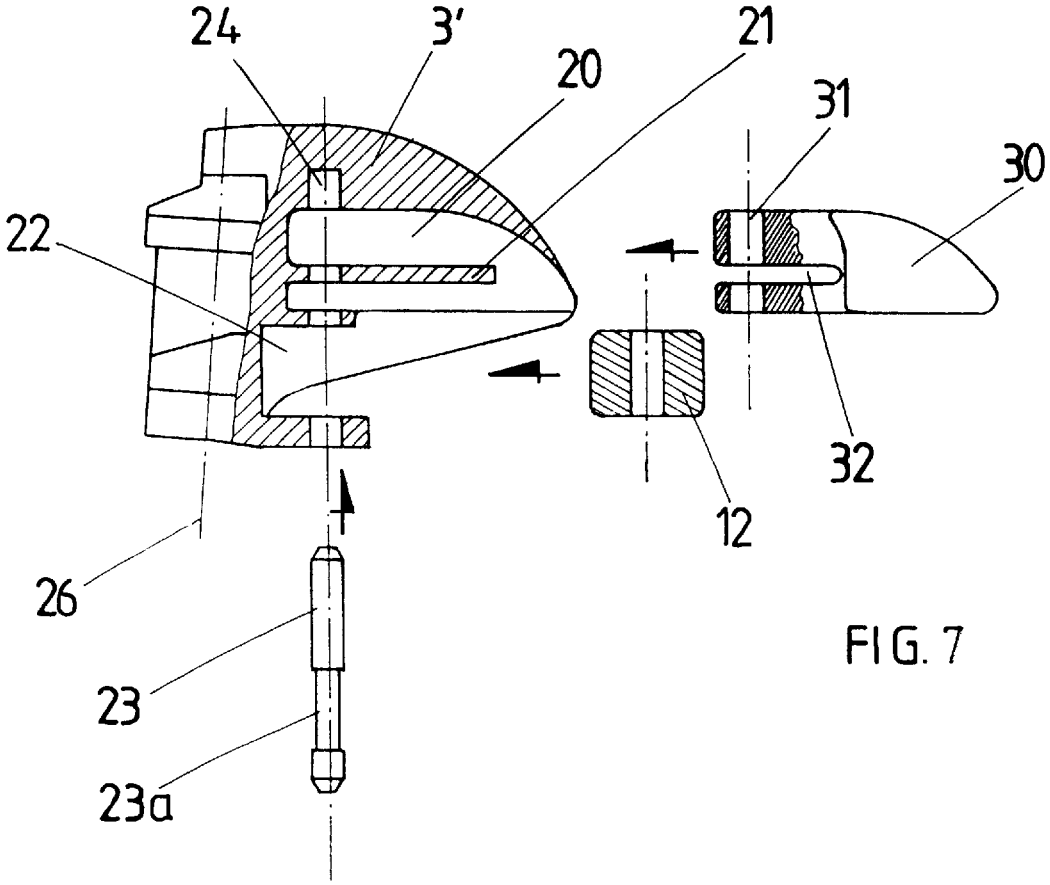
FIG. 7 is a view in section along VII—VII in FIG. 6.
Figure 6:
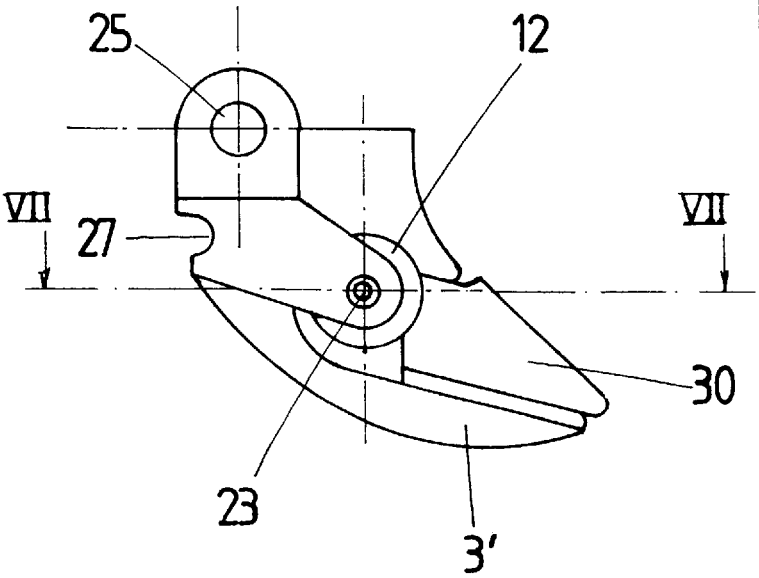
FIG. 6 is a view from above of the right arm of a variant of the first embodiment.

The mounting of the lateral-bearing and front-bearing means on the arms of the jaw can be simplified and rationalized by means of the construction shown in FIGS. 6 and 7.

The arm 3', seen from below in FIG. 6, like the arm 3 in FIG. 3, is equipped with an added piece 30 with a low coefficient of friction intended to bear on the upper of the boot, as described previously. This piece 30 has a hole 31, as well as a slot 32 perpendicular to the axis of the hole 31. The piece 30 is mounted in a housing 20 of the arm 3', which has a rib 21 which engages in the slot 32.

The arm 3' is moreover equipped with a roller 12 located below the piece 30 and intended to serve as support for the front part of the sole of the boot. This roller 12 is mounted in a housing 22 of the arm 3'.

The roller 12 and the bearing piece 30 are retained in the arm 3' by means of a common pin 23 driven into a hole 24 running through the housings 20 and 22 of the arm. In its lower half, the pin 23 has a portion 23*a* of reduced section which allows the roller 12 to turn with play about the pin 23.

FIG. 6 also shows on the arm 3' a hole 25 for the passage of a spindle 26, indicated in dot/dash lines in FIG. 7, for connection of the arm to the rod 5 shown in FIG. 3, as well as a rounded indentation 27 constituting the pivoting point of the arm on the rib 18 of the body of the binding, as shown in FIG. 5 and described in Patent EP 0 295 372.

The left arm is made in an identical manner.

What is claimed is:

1. A safety binding for fixing a ski boot with a projecting sole on a ski, said safety binding comprising a jaw having two arms (3, 4) which are independently rotatable so as to open in an opposite manner to one another when the ski boot is put on with an underside of the arms capable of retaining the ski boot vertically via its projecting sole (10), the jaw being able to pivot laterally under the action of the ski boot and counter to the action of a return spring (7), wherein the two arms (3, 4) of the jaw have bearing means intended to bear on an upper of the ski boot on either side of the ski boot, and wherein said binding has bearing means (12, 13, 17) intended to serve as support for a front part of the sole of the ski boot to adapt the opening of the arms of the jaw to the ski boot.

2. The binding as claimed in claim 1, wherein the bearing means (12, 13) are mounted on the arms of the jaw.

3. The binding as claimed in claim 1, wherein the bearing means are equipped with rollers (12, 13) with a vertical axis.

4. The binding as claimed in claim 1, wherein the arms (3, 4) of the jaw are equipped with pieces with a low coefficient of friction in their zone which bears on an upper of a boot.

5. The binding as claimed in claim 1, wherein the arms (3, 4) of the jaw are each equipped with at least one roller in their zone which bears on an upper of a boot.

6. The binding as claimed in claim 3, wherein the arms of the jaw constitute levers which are respectively rotatable about two separate vertical axes located on either side of the longitudinal axis of the binding, and wherein the rollers (12, 13) are mounted at points located between the pivoting axis and that part of the arm bearing against an upper of a boot.

* * * * *